US006186127B1

(12) United States Patent
Everingham

(10) Patent No.: US 6,186,127 B1
(45) Date of Patent: Feb. 13, 2001

(54) COOLANT MANIFOLD ADAPTER FOR INTEGRATED MOUNTING OF EEGR VALVE AND THROTTLE BODY ON AN ENGINE

(75) Inventor: Gary M. Everingham, Chatham (CA)

(73) Assignee: Siemens Canada Limited, Mississauga (CA)

( * ) Notice: Under 35 U.S.C. 154(b), the term of this patent shall be extended for 0 days.

(21) Appl. No.: 09/398,886

(22) Filed: Sep. 20, 1999

(51) Int. Cl.[7] ..... F02M 25/07
(52) U.S. Cl. ..... 123/568.12; 123/568.18
(58) Field of Search ..... 123/568.11, 568.12, 123/568.17, 568.18, 568.19, 568.21

(56) References Cited

U.S. PATENT DOCUMENTS

| | | | | |
|---|---|---|---|---|
| 3,457,906 | * | 7/1969 | Daigh | 123/568.12 |
| 5,666,930 | | 9/1997 | Elder | 123/568.12 |
| 5,746,190 | * | 5/1998 | Honda | 123/568.18 |
| 5,901,690 | | 5/1999 | Hussey et al. | 123/568.26 |
| 5,901,940 | | 5/1999 | Hussey et al. | 251/129.15 |
| 5,970,960 | * | 10/1999 | Azuma | 123/568.12 |
| 5,988,148 | * | 11/1999 | Astner et al. | 123/568.18 |
| 6,039,034 | * | 3/2000 | Field et al. | 123/568.18 |

* cited by examiner

*Primary Examiner*—Willis R. Wolfe

(57) ABSTRACT

An exhaust gas recirculation valve for an internal combustion engine (16). A one-piece adapter part (10; 10') contains a combustion air passageway (34) through which combustion air can enter the engine and a coolant passageway (18) through which engine coolant can flow. The adapter part also has an exhaust gas recirculation passageway (22) through which engine exhaust gas can be introduced into the combustion air passageway. An electric-operated exhaust gas recirculation valve (12) for controlling the recirculation of engine exhaust gas through the engine has a valve member (28) that is positionable with respect to a valve seat (26) that circumscribes the exhaust gas passageway in the adapter part.

7 Claims, 5 Drawing Sheets

COOLANT MANIFOLD ADAPTER FOR INTEGRATED MOUNTING OF EEGR VALVE AND THROTTLE BODY ON AN ENGINE

FIELD OF THE INVENTION

This invention relates generally to a internal combustion engines of motor vehicles, and in particular to a coolant manifold adapter for integrated mounting of an electric exhaust gas recirculation valve (EEGR valve) and throttle body assembly on an engine.

BACKGROUND OF THE INVENTION

Controlled engine exhaust gas recirculation is a commonly used technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the induction fuel-air flow entering the engine for combustion so as to limit the combustion temperature and hence reduce the formation of oxides of nitrogen.

Because they are typically engine-mounted, EGR valves are subject to a harsh operating environment that includes wide temperature extremes and vibrations. Exhaust emission requirements impose more stringent demands for improved control of such valves. Use of an electric actuator is one means for obtaining improved control, but in order to be commercially successful, such an actuator must be able to operate properly in such extreme environments for an extended period of usage.

SUMMARY OF THE INVENTION

It is believed that engine coolant can provide some degree of cooling of an EEGR valve, and one aspect of the present invention relates to flowing engine coolant through a passageway proximate an EEGR valve, and especially in a manner that integrates what were heretofore separate individual parts in a new and advantageous way.

One general aspect of the invention relates to an internal combustion engine comprising: a cooling system through which liquid coolant is circulated; a mounting surface circumscribing a combustion air inlet through which combustion air enters the engine; an exhaust system through which exhaust gas resulting from combustion within the engine exits the engine; a one-piece adapter part mounted on the engine at the mounting surface and comprising a combustion air outlet in registration with the engine combustion air inlet; the adapter part further comprising a combustion air inlet, a coolant inlet, and a coolant outlet; an electric-operated exhaust gas recirculation valve for controlling the recirculation of engine exhaust gas through the engine and comprising a valve member that is positionable with respect to a valve seat that circumscribes an exhaust gas passageway in the adapter part; the adapter part further comprising an exhaust gas inlet that is communicated to the exhaust gas system for supplying exhaust gas to an inlet of the exhaust gas passageway; a throttle body assembly for controlling flow of combustion air into the engine and comprising a throttle body which is mounted on the adapter part and has an air outlet in registration with the combustion air inlet of the adapter part and a combustion air inlet through which combustion air enters the throttle body; the adapter part further comprising a first passageway that places its combustion air inlet, its combustion air outlet, and an outlet of its exhaust gas passageway in common, and a second passageway that places its coolant inlet and its coolant outlet in common; and wherein the engine cooling system is communicated to the coolant inlet and the coolant outlet of the adapter part to flow coolant through the second passageway.

Another general aspect of the invention relates to an exhaust gas recirculation valve for an internal combustion engine, comprising: a one-piece adapter part comprising a combustion air passageway through which combustion air can enter the engine and a coolant passageway through which engine coolant can flow; the adapter part further comprising an exhaust gas passageway through which engine exhaust gas can be introduced into the combustion air passageway; an electric-operated exhaust gas recirculation valve for controlling the recirculation of engine exhaust gas through the engine and comprising a valve member that is positionable with respect to a valve seat that circumscribes the exhaust gas passageway in the adapter part.

Further aspects of the invention will be presented in the following drawings, detailed description, and claims.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
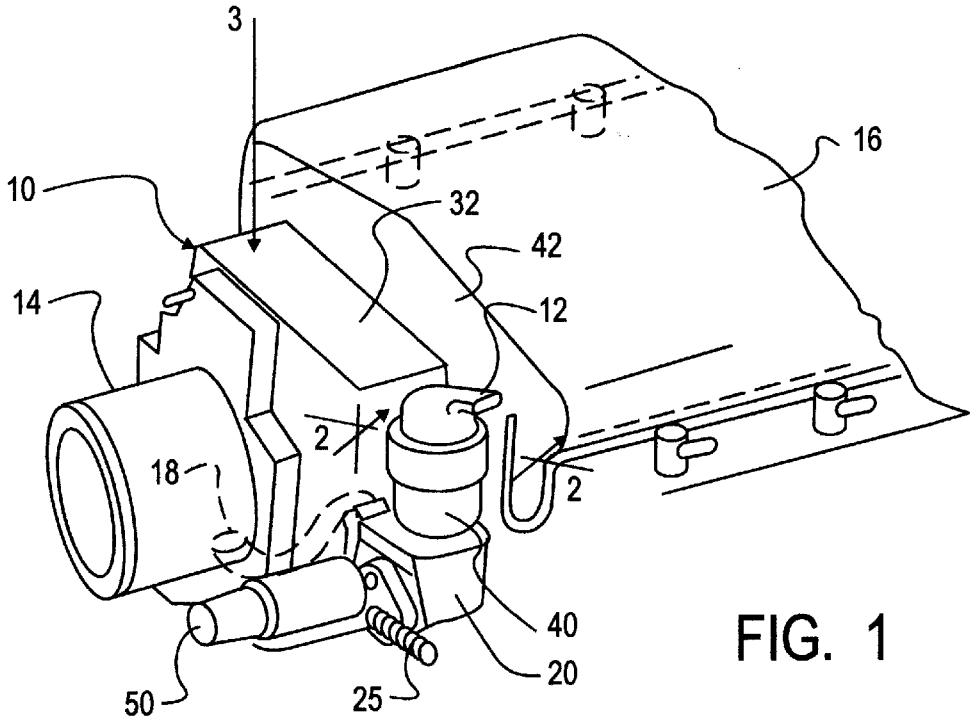
FIG. 1 is a partial perspective view of an engine embodying principles of the present invention.
Figure 2:
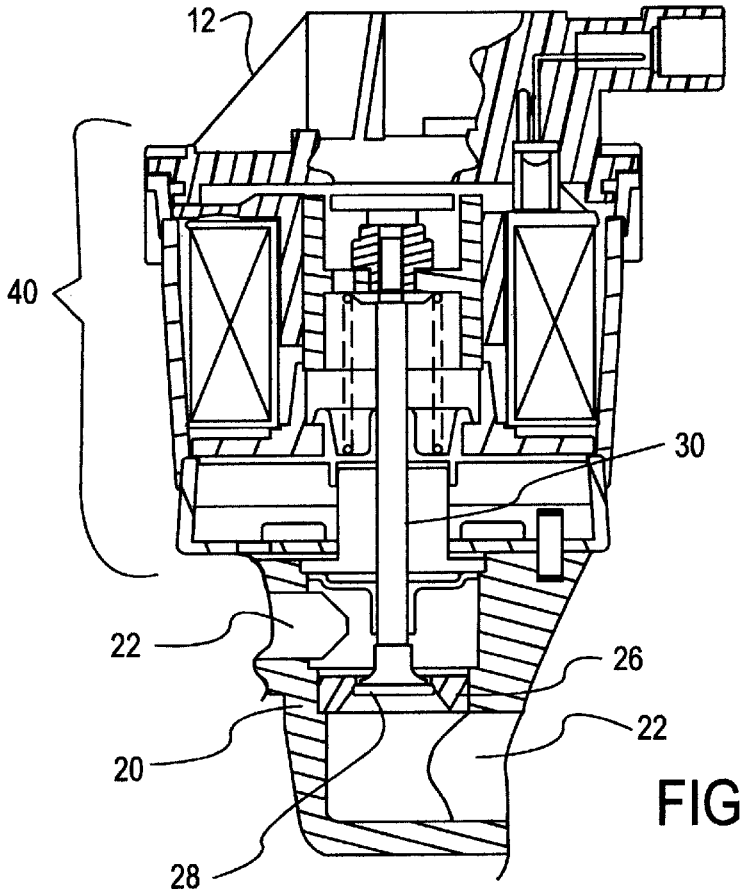
FIG. 2 is a transverse cross section view on an enlarged scale in the general direction of arrows 2—2 in FIG. 1.
Figure 3:
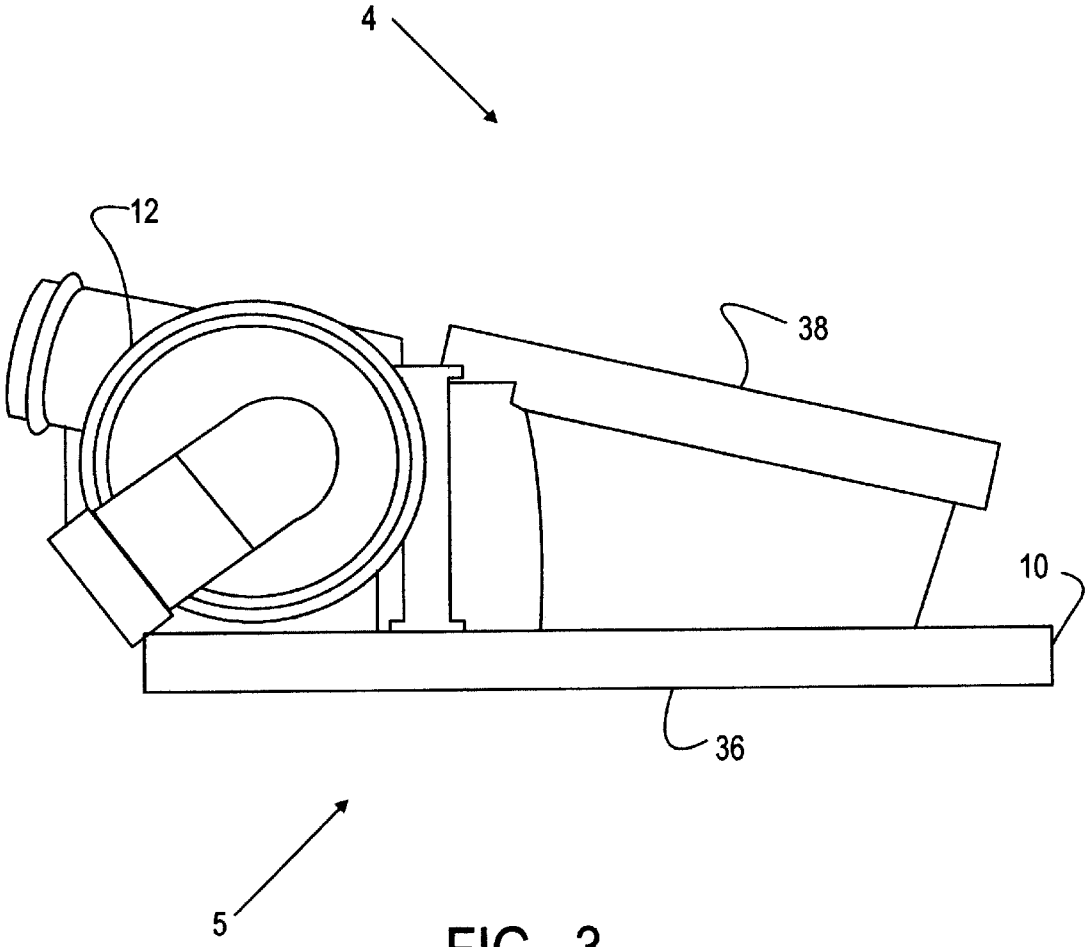
FIG. 3 is an enlarged view in the direction of arrow 3 in FIG. 1.
Figure 4:
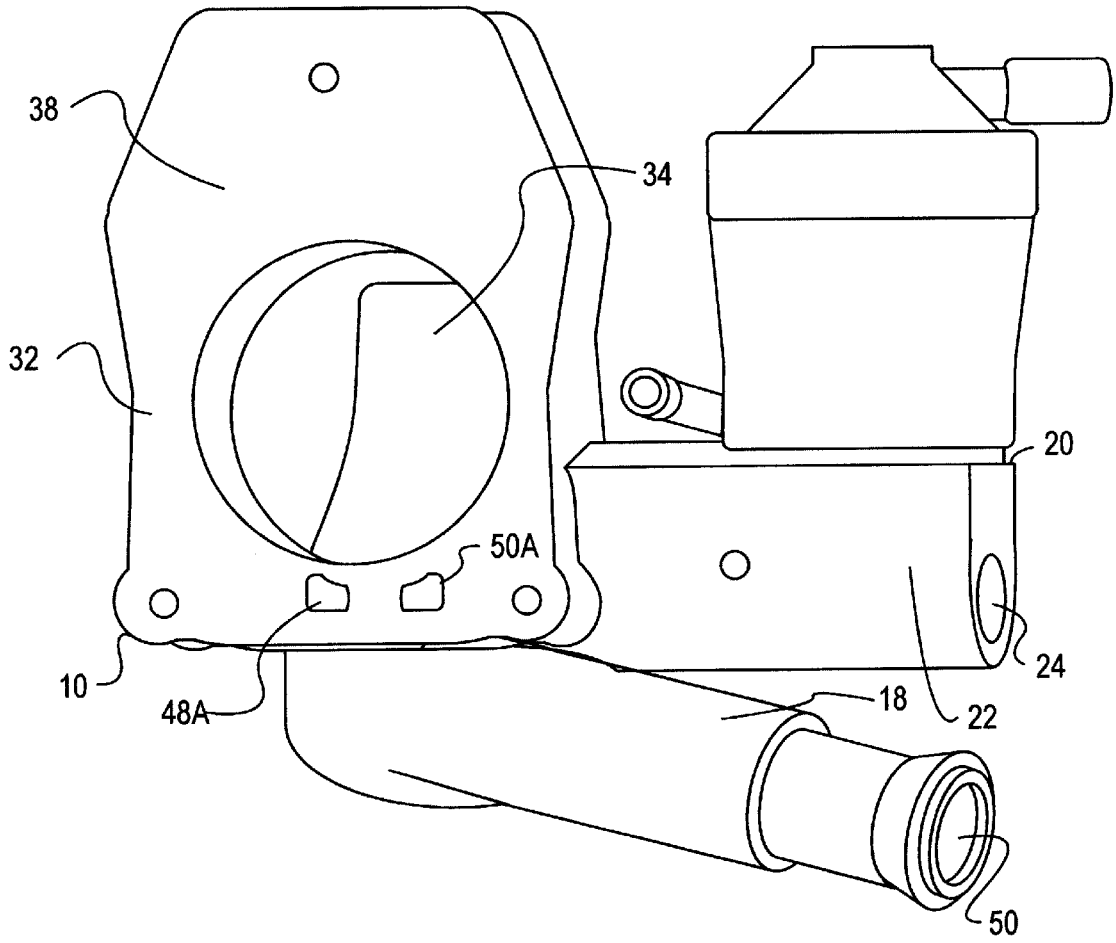
FIG. 4 is a view in the general direction of arrow 4 in FIG. 3.
Figure 5:
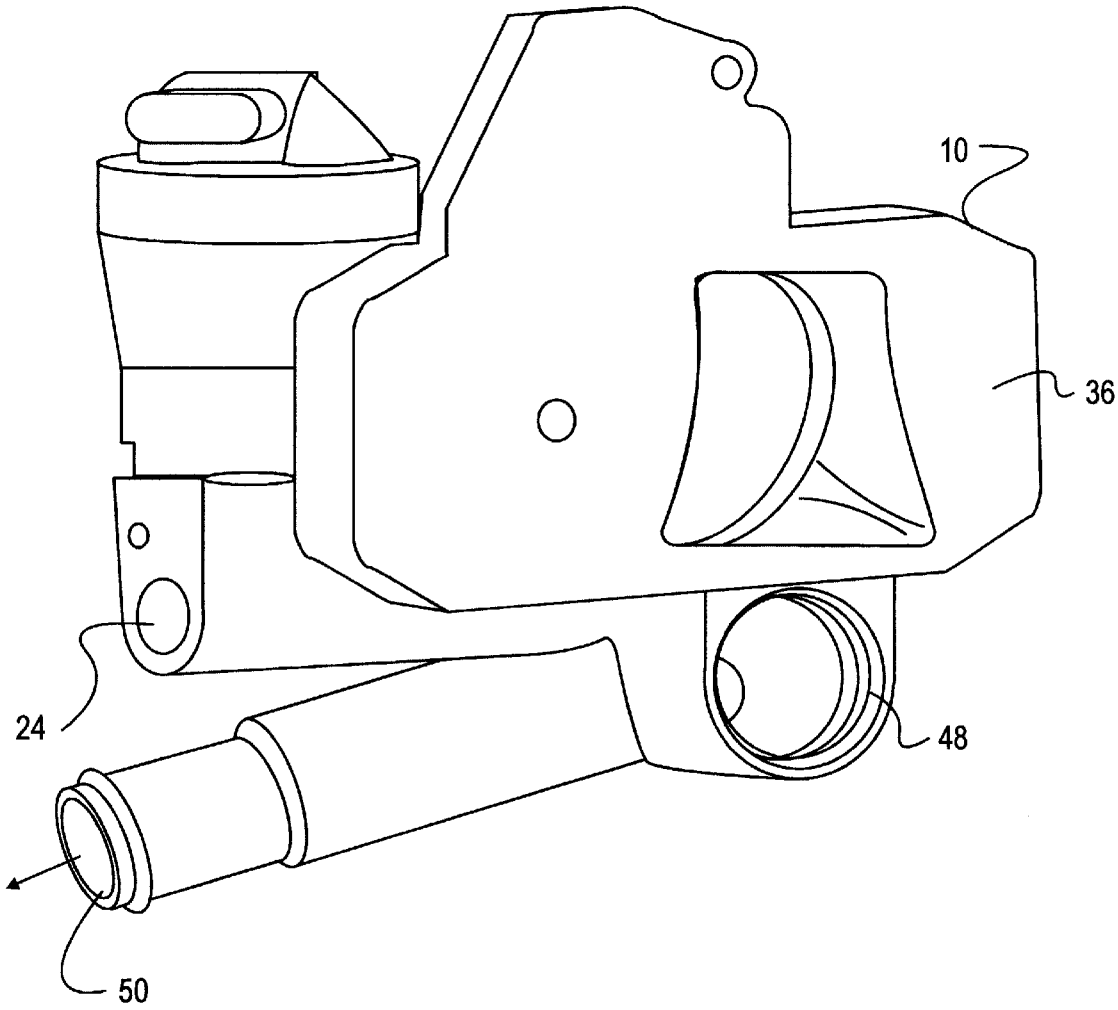
FIG. 5 is a view in the general direction of arrow 5 in FIG. 3.

FIG. 1 shows an adapter part 10 that serves as a medium for the mounting of an electric exhaust gas recirculation (EEGR) valve 12 and the mounting of a throttle body 14 on an internal combustion engine 16 while providing a coolant passageway 18 through which engine coolant that is circulated by the engine cooling system is conveyed in thermal relationship to the EEGR valve and to the throttle body. Moreover, as shown by FIGS. 2–5, one portion 20 of adapter part 10 serves as a base of EEGR valve 12 for integrating the EEGR valve with the adapter part to eliminate a number of individual parts that would otherwise be required to join the valve to the adapter.

Adapter part 10 is fabricated as a unitary part of homogeneous material throughout, for example an aluminum casting suitably processed for the conveyance of the various fluids involved. Adapter part 10 comprises an exhaust gas recirculation passageway 22 that has an inlet, or entrance, 24 adapted to be communicated to engine exhaust gas, such as by a conduit (shown in FIG. 1 by the reference 25) leading to an engine exhaust manifold. Within a portion of passageway 22 interior of entrance 24, an annular valve seat element 26 is secured in any suitable manner, such as by staking. EEGR valve 12 comprises a valve member which has a head 28 on a valve stem 30. Head 28 is shown seated on seat element 26, closing passageway 22 to flow. When EEGR valve 12 operates to displace stem 30 downward, head 28 unseats from seat element 26 to allow exhaust gas flow through passageway 22.

Another portion 32 of adapter part 10 is disposed adjacent portion 20 and comprises a walled through-passageway 34 whose opposite ends are open at spaced apart mounting surfaces 36, 38. Exhaust gas recirculation passageway 22 comprises an exit that opens to through-passageway 34 at a location in the latter's wall that is between surfaces 36, 38. When EEGR valve 12 is operated open, exhaust gas can flow through passageway 22 and be delivered into through-passageway 34.

The construction of EEGR valve 12 designated by the general reference 40 is generally like that disclosed in commonly owned U.S. Pat. Nos. 5,901,690 and 5,901,940, each of which is incorporated herein in its entirety by reference. It can be appreciated that the EEGR base (reference 12 of the incorporated patents) is provided by portion 20 of adapter part 10 in the present invention. This integration is believed to provide meaningful economies by elimination of a number of separate parts otherwise needed to join the valve and the adapter, and of steps in processes for making an assembly embodying the present invention.

Surface 36 is adapted to be disposed against a mounting surface of a portion of engine 16 that contains an intake system through which combustion air can flow to individual engine cylinders for use in combustion processes occurring within the cylinders, for example an intake manifold 42 containing runners leading to the cylinders. The mounting of adapter part 10 on engine 16 places the downstream end of through-passageway 34 in registration with an entrance of the intake system in manifold 42.

A surface of throttle body 14 is disposed against surface 38 to place a downstream end of an airflow passage that extends through throttle body 14 in registration with the upstream end of through-passageway 34. A throttle blade (not shown) is disposed within the airflow passage of throttle body 14 to selectively restrict flow through the airflow passage, and hence airflow entering intake manifold 42.

A further feature of adapter part 10 is coolant passageway 18, through which engine coolant that is circulated through the engine cooling system passes. Passageway 18 has an entrance 48 via which coolant enters and an exit 50 via which coolant exits. The passage of coolant through passageway 18 provides beneficial cooling of EEGR valve 12 and heating of throttle body 14. Coolant for heating throttle body 14 is shunted from passageway 18 by a tap passage 48A extending from passageway 18 to surface 38. A second tap passage 50A extends from passageway 18 at a location slightly downstream of the location where tap passage 48A intersects passageway 18 to a location on surface 38 adjacent, but spaced from, the location of tap passage 48A. Throttle body 14 contains a coolant passageway having an entrance that is communicated to tap passage 48A and an exit that is communicated to tap passage 50A. When coolant flows through passageway 18, a slight restriction in the passageway that is between tap passage 48A and tap passage 50A causes a portion of the flow to be shunted through tap passage 48A to the throttle body coolant passage and thence back to passageway 18 through tap passage 50A. It should be mentioned that in FIG. 1, the outlet tube that contains coolant exit 50, and the exhaust gas entrance 24 are about 90 degrees out of position from the views of FIGS. 3–5.

Figure 6:
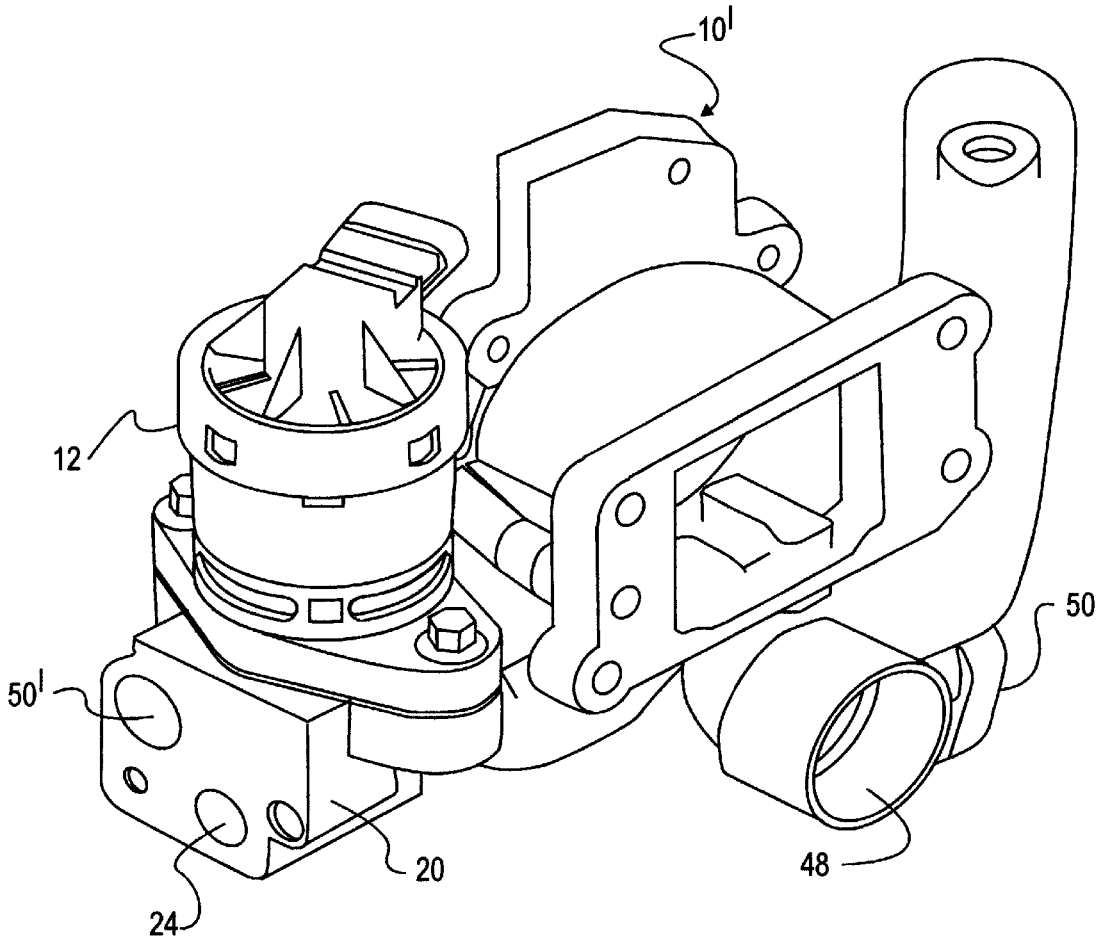
FIG. 6 is a perspective view of another embodiment.

FIG. 6 shows a modified adapter part 10'. The same reference numerals that were used in FIGS. 1–5 are used in FIG. 6 to identify the same components. Hence, the description of FIGS. 1–5 given above applies to FIG. 6 without repetition, and the latter Figure will be described to the extent of explaining significant differences between it and adapter part 10. Exhaust gas entrance 24 and a second coolant exit 50' are in the same wall of the adapter facing in the opposite direction from exit 50, which is to the opposite side. Internally of adapter part 10', coolant passageway 18 branches, with one branch running to exit 50 and the other to exit 50'. Because the view of FIG. 6 is from an opposite direction, the tap passages to the throttle body cannot be seen in FIG. 6.

It should be understood that because the invention may be practiced in various forms within the scope of the appended claims, certain specific words and phrases that may be used to describe a particular exemplary embodiment of the invention are not intended to necessarily limit the scope of the invention solely on account of such use. For example, the tap passages to the throttle body may be omitted if heating of the throttle body is not desired.

What is claimed is:

1. An exhaust gas recirculation valve for an internal combustion engine comprising:

a one-piece adapter part comprising a combustion air passageway through which combustion air can enter the engine and a coolant passageway through which engine coolant can flow;

the adapter part further comprising an exhaust gas passageway through which engine exhaust gas can be introduced into the combustion air passageway;

an electric-operated exhaust gas recirculation valve for controlling the recirculation of engine exhaust gas through the engine and comprising a valve member that is positionable with respect to a valve seat that circumscribes the exhaust gas passageway in the adapter part.

2. An internal combustion engine comprising:

a cooling system through which liquid coolant is circulated;

a mounting surface circumscribing a combustion air inlet through which combustion air enters the engine;

an exhaust system through which exhaust gas resulting from combustion within the engine exits the engine;

a one-piece adapter part mounted on the engine at the mounting surface and comprising a combustion air outlet in registration with the engine combustion air inlet;

the adapter part further comprising a combustion air inlet, a coolant inlet, and a coolant outlet;

an electric-operated exhaust gas recirculation valve for controlling the recirculation of engine exhaust gas through the engine and comprising a valve member that is positionable with respect to a valve seat that circumscribes an exhaust gas passageway in the adapter part;

the adapter part further comprising an exhaust gas inlet that is communicated to the exhaust gas system for supplying exhaust gas to an inlet of the exhaust gas passageway;

a throttle body assembly for controlling flow of combustion air into the engine and comprising a throttle body which is mounted on the adapter part and has an air outlet in registration with the combustion air inlet of the adapter part and a combustion air inlet through which combustion air enters the throttle body;

the adapter part further comprising a first passageway that places its combustion air inlet, its combustion air outlet, and an outlet of its exhaust gas passageway in common, and a second passageway that places its coolant inlet and its coolant outlet in common; and wherein the engine cooling system is communicated to the coolant inlet and the coolant outlet of the adapter part to flow coolant through the second passageway.

3. An internal combustion engine as set forth in claim 2 further including tap passages shunting coolant from the second passageway through the throttle body.

4. An internal combustion engine as set forth in claim 2 in which the adapter part comprises two coolant outlets, and the second passageway branches within the adapter part to both coolant outlets.

5. An internal combustion engine as set forth in claim 4 in which the first passageway comprises a straight throughbore between the combustion air inlet and the combustion air outlet, the adapter part comprises a receptacle space for the exhaust gas recirculation valve disposed laterally of the throughbore, and one branch of the second passageway runs laterally of the throughbore alongside the receptacle space to one of the coolant outlets.

6. An exhaust gas recirculation valve as set forth in claim 2 in which the adapter part comprises two coolant outlets, and the coolant passageway branches within the adapter part to both coolant outlets.

7. An exhaust gas recirculation valve as set forth in claim 6 in which the combustion air passageway comprises a straight throughbore, the adapter part comprises a receptacle space for the exhaust gas recirculation valve disposed laterally of the throughbore, and one branch of the second passageway runs laterally of the throughbore alongside the receptacle space to one of the coolant outlets.

* * * * *